US008341890B2

(12) United States Patent
Staser et al.

(10) Patent No.: US 8,341,890 B2
(45) Date of Patent: Jan. 1, 2013

(54) DUAL CHANNEL CABLE DRIVE WINDOW LIFT SYSTEM

(75) Inventors: Brian H. Staser, Oxford, MI (US); Fred L. Sawgle, Lapeer, MI (US)

(73) Assignee: Inteva Products, LLC, Troy, MI (US)

( * ) Notice: Subject to any disclaimer, the term of this patent is extended or adjusted under 35 U.S.C. 154(b) by 166 days.

(21) Appl. No.: 12/783,343

(22) Filed: May 19, 2010

(65) Prior Publication Data

US 2010/0293857 A1 Nov. 25, 2010

Related U.S. Application Data

(60) Provisional application No. 61/179,544, filed on May 19, 2009, provisional application No. 61/179,522, filed on May 19, 2009, provisional application No. 61/179,535, filed on May 19, 2009.

(51) Int. Cl.
*E05F 11/48* (2006.01)

(52) U.S. Cl. ..... 49/348; 49/352; 49/502

(58) Field of Classification Search ..... 49/348, 49/349, 352, 374, 502; 296/146.2, 146.16
See application file for complete search history.

(56) References Cited

U.S. PATENT DOCUMENTS

| | | | | |
|---|---|---|---|---|
| 5,555,677 | A * | 9/1996 | DeRees et al. | 49/502 |
| 5,617,675 | A * | 4/1997 | Kobrehel | 49/352 |
| 5,632,121 | A * | 5/1997 | Handte et al. | 49/502 |
| 6,115,966 | A * | 9/2000 | Shibata | 49/352 |
| 6,477,808 | B1 * | 11/2002 | Arquevaux et al. | 49/352 |
| 6,820,370 | B2 * | 11/2004 | Marscholl | 49/352 |
| 7,263,804 | B2 * | 9/2007 | Ishii et al. | 49/352 |
| 7,490,438 | B1 | 2/2009 | Maass et al. | |
| 7,610,720 | B2 * | 11/2009 | Kirejczyk et al. | 49/352 |
| 7,627,989 | B2 * | 12/2009 | Ootsuki et al. | 49/352 |
| 7,631,458 | B2 * | 12/2009 | Moriyama et al. | 49/352 |
| 2007/0163177 | A1 * | 7/2007 | Heyer et al. | 49/348 |
| 2007/0214726 | A1 * | 9/2007 | Graf et al. | 49/352 |
| 2008/0222962 | A1 * | 9/2008 | Staser et al. | 49/502 |

FOREIGN PATENT DOCUMENTS

| | | | |
|---|---|---|---|
| JP | 2005-156861 | A | 6/2005 |
| WO | 03045736 | A2 | 6/2003 |

OTHER PUBLICATIONS

International Search Report dated Dec. 22, 2010; International Application No. PCT/US2010/035434.
Written Opinion dated Dec. 22, 2010; International Application No. PCT/US2010/035434.

* cited by examiner

*Primary Examiner* — Katherine W Mitchell
*Assistant Examiner* — Justin Rephann
(74) *Attorney, Agent, or Firm* — Cantor Colburn LLP

(57) ABSTRACT

A dual channel window lift assembly is provided, the assembly having: a door bracket; a pair of guide rails each being rotationally mounted to the door bracket for rotational movement in a predetermined range; and a cable assembly secured to the door bracket wherein at least one cable of the cable assembly is not received within a conduit and the at least one cable is secured to as least one pulley rotationally mounted to the one of the pair of guide rails and the at least one cable remains on the at least one pulley as the pair of guide rail each rotate within the predetermined range.

14 Claims, 5 Drawing Sheets

DUAL CHANNEL CABLE DRIVE WINDOW LIFT SYSTEM

CROSS REFERENCE TO RELATED APPLICATIONS

This application claims the benefit of U.S. Provisional Patent Application Ser. No. 61/179,544 filed May 19, 2009 the contents of which are incorporated herein by reference thereto.

This application also claims the benefit of U.S. Provisional Patent Application Ser. No. 61/179,535 filed May 19, 2009 the contents of which are incorporated herein by reference thereto.

This application also claims the benefit of U.S. Provisional Patent Application Ser. No. 61/179,522 filed May 19, 2009 the contents of which are incorporated herein by reference thereto.

BACKGROUND

Exemplary embodiments of the present invention relate to assemblies for vehicle windows and more particularly to a dual channel window lift assembly with a door bracket.

Dual channel cable drive window lift systems in some door builds are usually loaded into the door in a flexible state, i.e., the rails and cables are held together by the spring loaded conduits of the cable system. This is convenient for door assembly but costly for component cost. The flexible assembly is loaded through a hole in the door inner and attached and datumed to the outboard surface of the door inner. If door brackets are needed, then an additional component is required to be installed over the hole that was needed for the regulator load.

Accordingly, it is desirable to provide a dual cable drive window lift system without additional components such as spring loaded conduits and brackets.

SUMMARY OF THE INVENTION

In accordance with an exemplary embodiment of the invention, a dual channel window lift assembly is provided, the assembly having: a door bracket; a pair of guide rails each being rotationally mounted to the door bracket for rotational movement in a predetermined range; and a cable assembly secured to the door bracket wherein at least one cable of the cable assembly is not received within a conduit and the at least one cable is secured to as least one pulley rotationally mounted to the one of the pair of guide rails and the at least one cable remains on the at least one pulley as the pair of guide rail each rotate within the predetermined range.

Additional features and advantages of the various aspects of exemplary embodiments of the present invention will become more readily apparent from the following detailed description in conjunction with the drawings wherein like reference numerals refer to corresponding parts in the several views.

Figure 1:
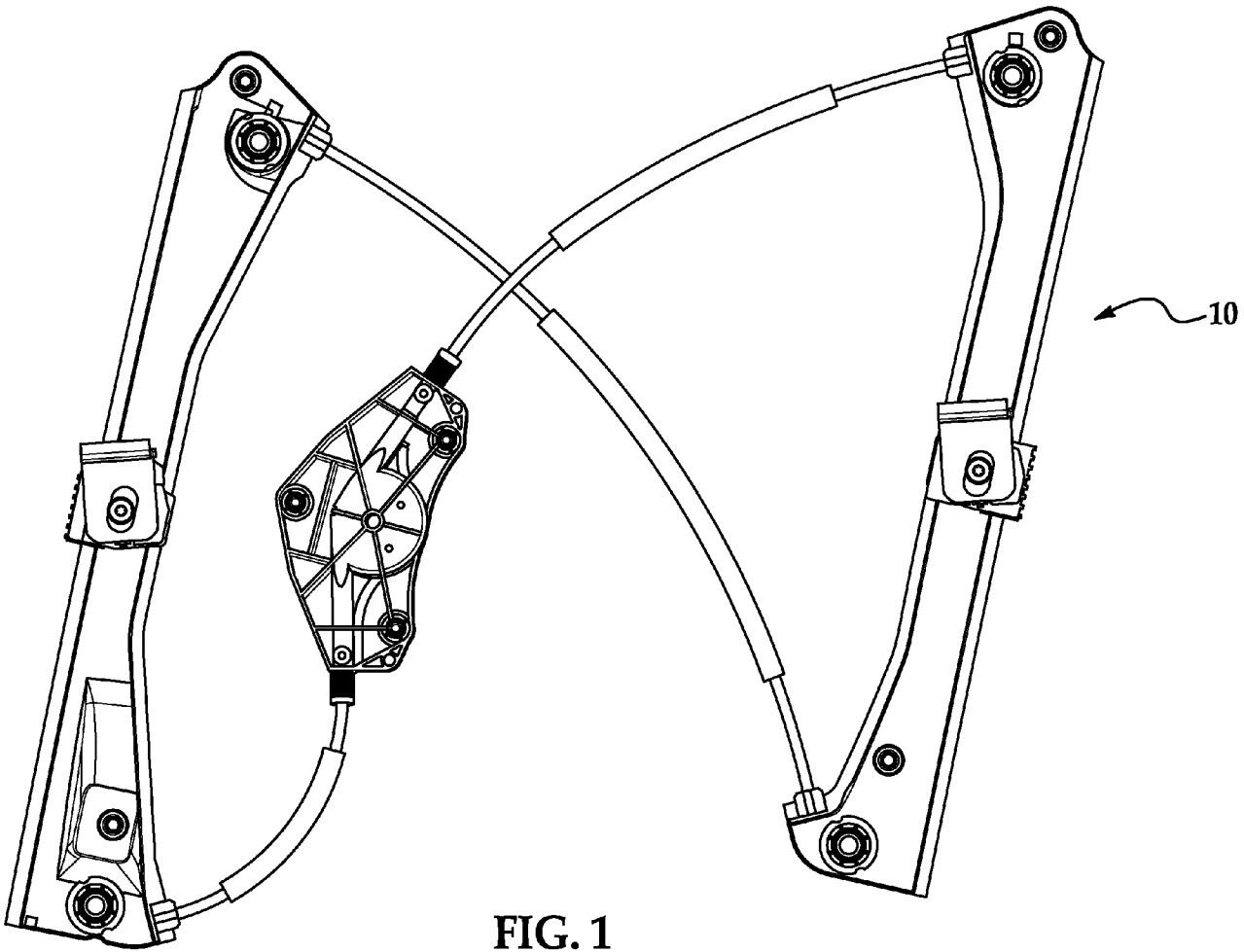
FIG. 1 illustrates a dual rail window lift system with spring loaded conduits.
Figure 2:
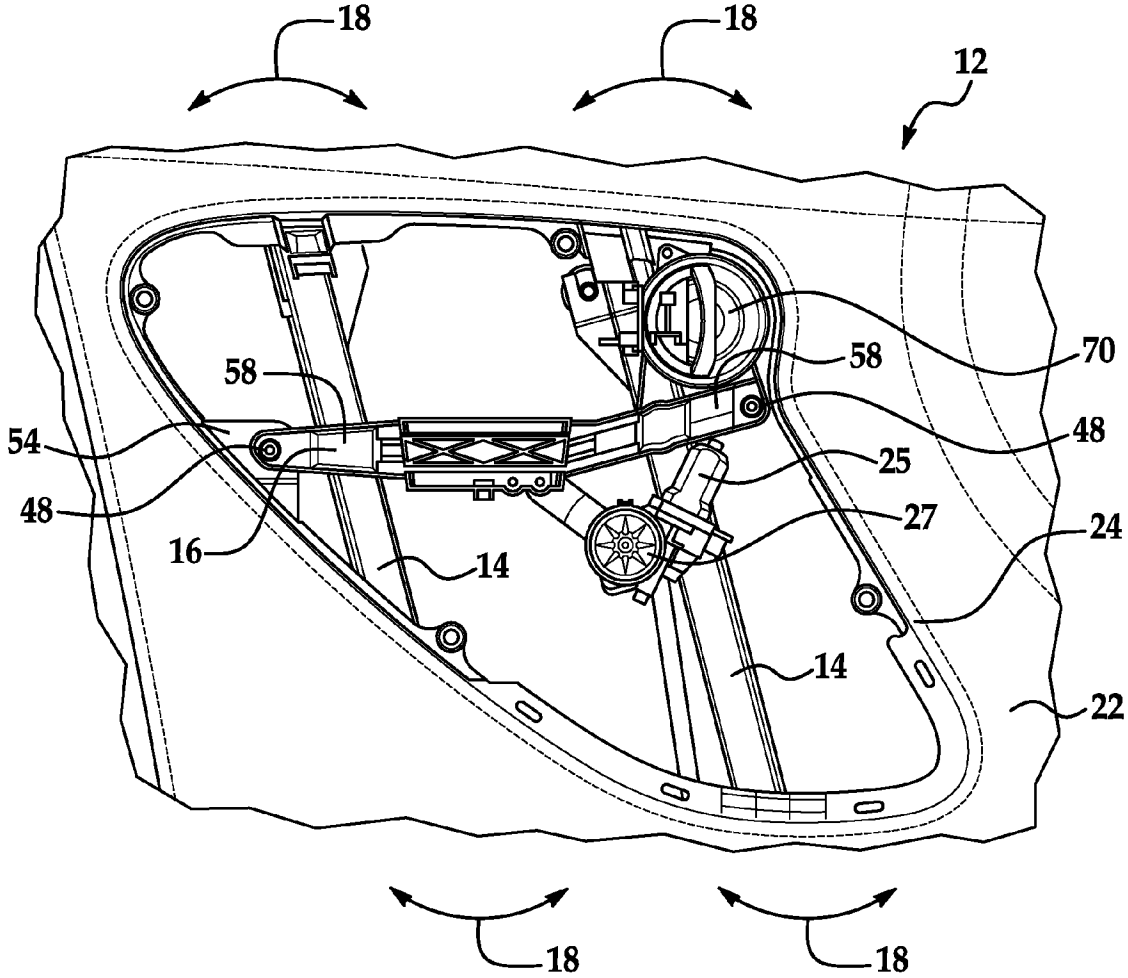
FIG. 2 is an inboard view of the dual rail window lift system of an exemplary embodiment secured to a vehicle door inner.
Figure 3:
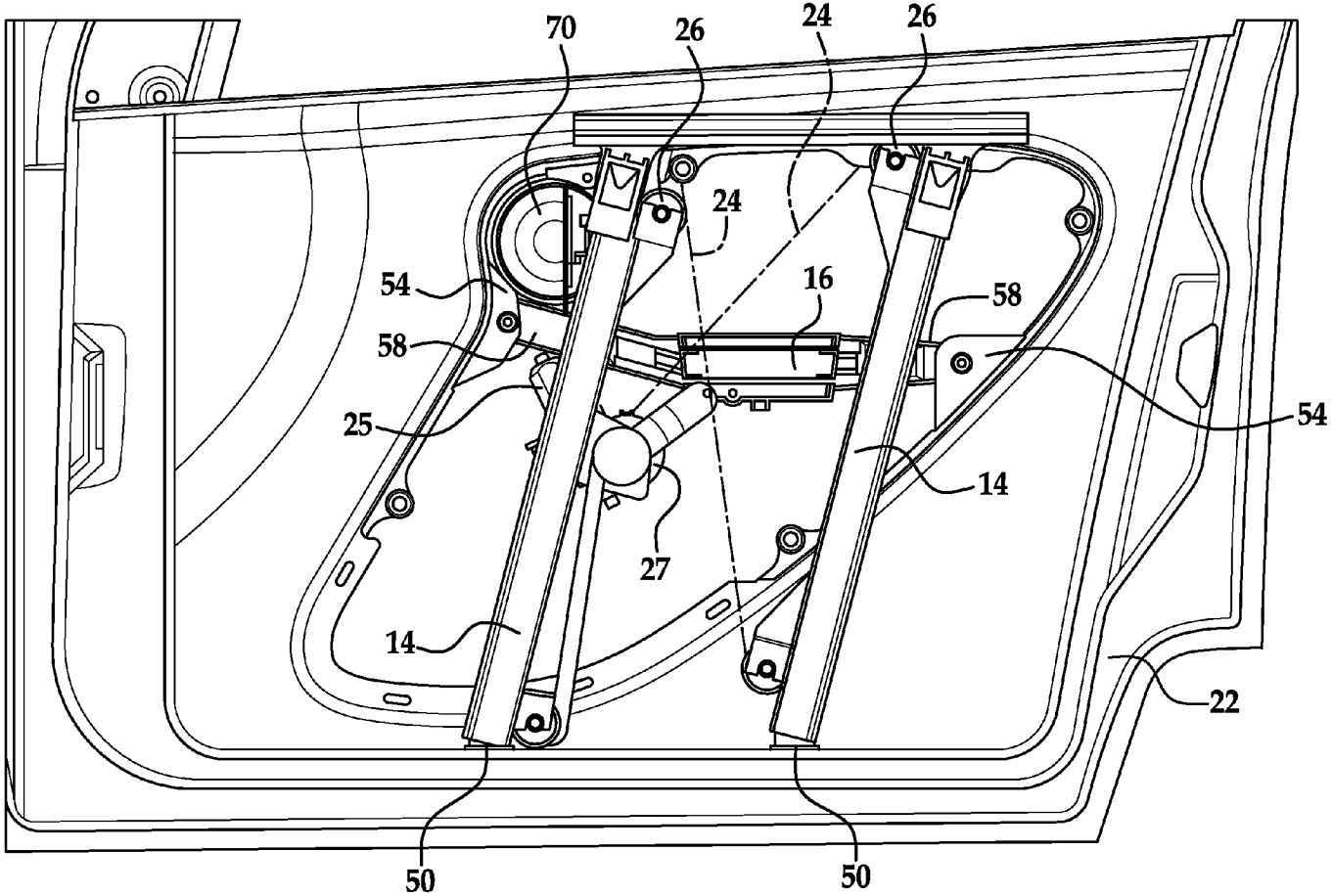
FIG. 3 is an outboard view of the dual rail window lift system of an exemplary embodiment secured to a vehicle door inner.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION OF EXEMPLARY EMBODIMENTS

Referring to the attached FIGS. exemplary embodiments of the present invention are illustrated and relate to an apparatus and method for providing a dual channel window assembly.

In accordance with an exemplary embodiment of the present invention, the cable regulator is combined with a door bracket in a manner that allows the dual channel system to be loaded and datumed to the door for proper function, but also to be constructed without spring loaded conduits for lower cost.

In one exemplary embodiment, the dual channel window assembly is configured to provide limited rotational stability to an interface between the guide rails and the door bracket, with good stability fore/aft, up/down, and inboard/outboard. In one exemplary embodiment, the door bracket provides more functionality than just carrying the regulator, i.e., a door pull cup attachment and inside handle carrier is also provided. In one exemplary embodiment, the dual channel window assembly is configured to provide limited rotational stability to an interface between the guide rail and the door bracket, with good stability fore/aft, up/down, and inboard/outboard. In one exemplary embodiment, the door bracket provides more functionality than just carrying the regulator, i.e., a door pull cup attachment and inside handle carrier is also provided. One non-limiting example is illustrated in U.S. Provisional Patent Application Ser. No. 61/179,522 filed May 19, 2009 the contents of which are incorporated herein by reference thereto. Reference is also made to U.S. Patent Publication Nos. US20080222962 filed Sep. 18, 2008; and U.S. Patent Publication US20100024306 filed Jul. 31, 2009, the contents each of which are incorporated herein by reference thereto.

Exemplary embodiments of this invention allow the regulator to be assembled without cables having conduits thereby allowing for lower cost cables to be used since the rails are held in position relative to each other by the door bracket. In one embodiment, the door bracket provides more functionality than just carrying the regulator, i.e.—door pull cup attachment and inside handle carrier. Therefore exemplary embodiments allow the regulator to be assembled with non-conduited cables (lower cost than conduited cables) because the rail is held in position relative to the motor by its securement to at least one of the guide rails. If the rails were not held in position, then the cables would come off of the pulleys. Exemplary embodiments of the present invention hold the rails in place, but also allows the rails to be located to the door once it is assembled therein. If the rails were located (datumed) by the door bracket, the rails could not be held in position to a tight enough tolerance to maintain function throughout the entire range of door build variation. By allowing the rails to be located (datumed) by the door, the traditional tolerancing stack-ups are maintained.

FIG. 1 shows a window lift system 10 with spring loaded conduits while FIGS. 2-10 illustrate exemplary embodiments of the present invention.

As shown, a window lift system 12 is provided wherein a pair of guide rails 14 are secured to a door bracket 16, as discussed above, the mounting of the guide rails to the bracket is configured to provide limited rotational movement and stability to an interface between the guide rails and the door bracket, with good stability fore/aft, up/down, and inboard/outboard.

Thus, limited movement of the guide rails in the direction of arrows 18 is provided for assisting in the mounting of the lift system as it is inserted into an opening 20 in the door inner 22 so the guide rails can be located or datumed to the door inner such limited movement allows for variances or door inner manufacturing tolerances.

As illustrated, exemplary embodiments allow the window lift system or window regulator to be assembled with cables 24 that do not have conduits thereby allowing for lower cost cables to be used since the rails are held in position relative to each other by the door bracket. If the rails were not held in position, then the cables would come off of the pulleys 26 secured to the guide rails. As illustrated, a motor 25 for driving a motor drum within a motor drum housing 27 is provided. The motor drum is secured to the cables and the cables are secured to a carrier which moves up and down as the motor is activated to effect movement of a window (not shown). In one non-limiting embodiment, the motor is secured to the bracket and in another non-limiting embodiment the motor may be secured to the guide rail. Of course, the motor may be secured in still other locations.

Exemplary embodiments of the present invention hold the rails in place, but also allows the rails to be located to the door once it is assembled therein (e.g., movement in the direction of arrows 18). If the rails were located (datumed) by the door bracket, the rails could not be held in position to a tight enough tolerance to maintain function throughout the entire range of door build variation. By allowing the rails to be located (datumed) by the door, the traditional tolerancing stack-ups are maintained.

Figure 8:
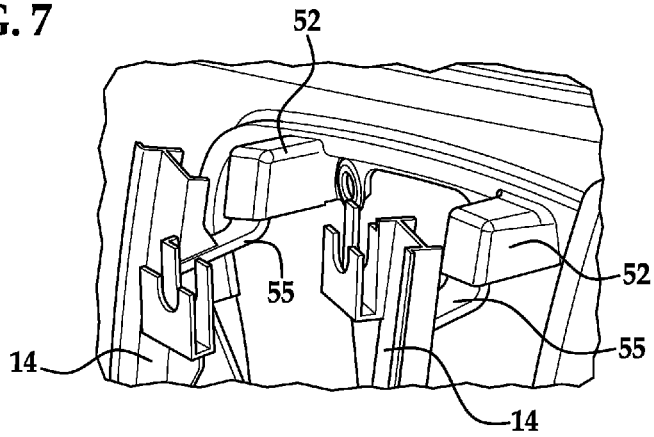
Figure 9:
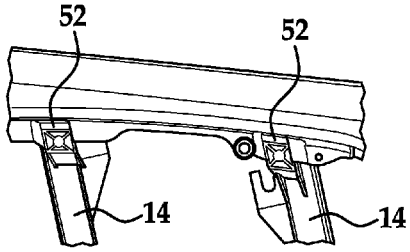
Figure 10:
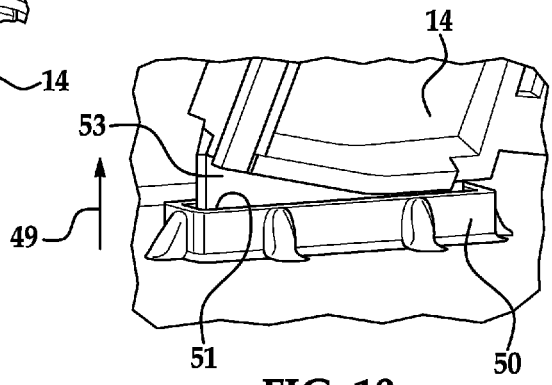

One non-limiting attachment of the rail to the door inner is shown at least in FIGS. 2-5 wherein the bottom of the rail is received in a cup or feature 50 that defines an opening 51 for receipt of a distal end 53 of the guide rail therein. The cup or feature has a plurality of walls that define opening 51 and provide 5-way locational control of the distal end of the rail therein (e.g., left to right or fore to aft; inboard and outboard and downward such that only the up direction (arrow 49) is not constrained by the cup or feature 50. At the opposite end or a top distal end 55 of the rail is held in a pocket or feature 52 of the door inner for 2-way control (for/aft or right to left) while allowing the distal end to be inserted into the pocket in an outboard direction until the distal end contacts a portion of the pocket or feature and the bracket is secured to the door inner. As illustrated in FIG. 8 the top distal end of the guide rail may have an arm member that extends away from the guide rail for receipt in feature 52 while other portions of the top of the guide rail are configured to rotationally receive a pulley therein. Of course, other alternative insertion methods into features 52 of different configurations may be used for example moving the distal end in an inboard direction until the feature is contacted and then securing the bracket.

The door bracket 16 secures the center of the rail in the inboard/outboard directions and holds the rail against upward movement in the direction of arrow 49 once the bracket is secured to the door inner, thus the system is secured in a manner that allows for several degrees of freedom, which in turn allows for numerous door build variations to be accommodated.

Figure 4:
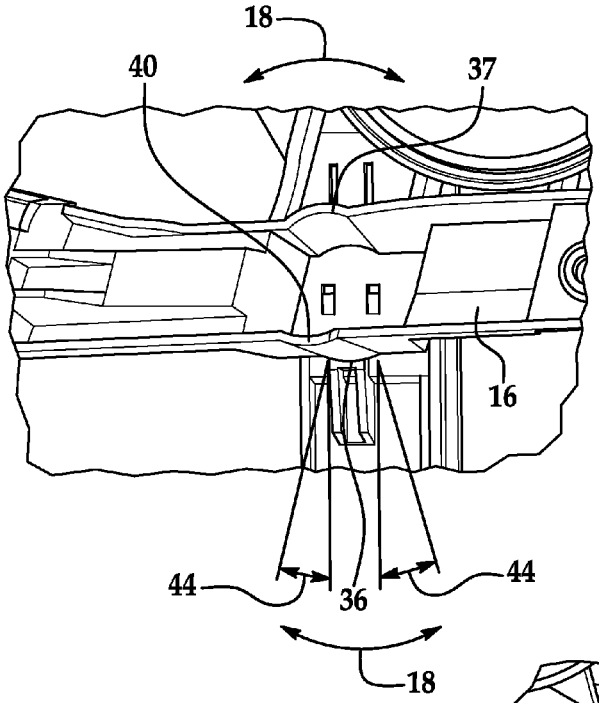
FIG. 4 is an inboard view of the rail to door bracket securement.
Figure 5:
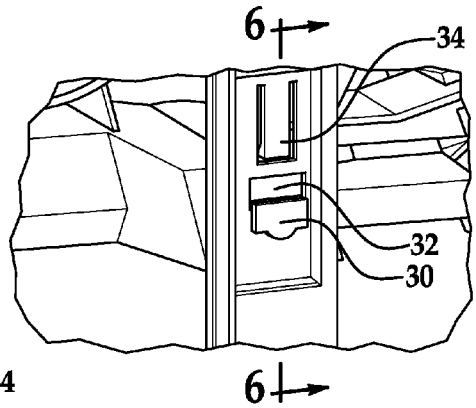
FIG. 5 is an outboard view of the rail to door bracket securement.
Figure 6:
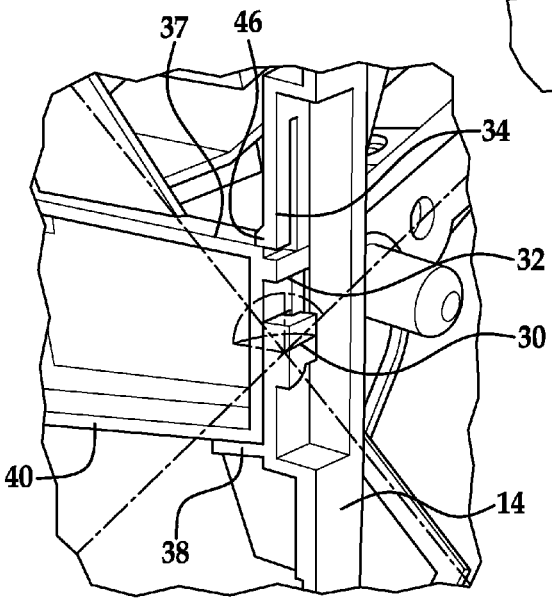
FIG. 6 is a cross-sectional view along lines 6-6 of FIG. 5.
Figure 7:
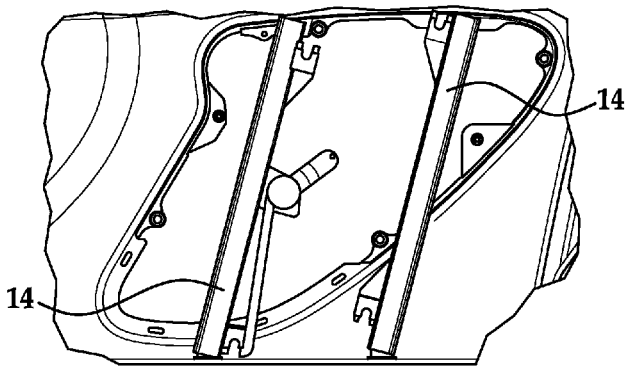
FIGS. 7-10 illustrate the upper and lower attachment features of the guide rails and the door inner.

As shown in FIGS. 4-6 one non-limiting configuration for securing the guide rails to the bracket is illustrated. Here a feature 30 of the bracket engages an opening 32 in each guide rail.

In addition, the guide rails each further comprises a resilient arm member 34 for engaging an upper curved surface 37 of the bracket after the feature engages the opening in the guide rail and the guide rail has a lower feature 38 for engaging a lower curved surface 40 of the bracket after the feature engages the opening in the guide rail such that the movement of the guide rail in the direction of arrows 18 with respect to the door bracket is allowed in a limited range while movements in other directions is prevented. Again, this movement is provided to allow for installation of the system to a door inner as it is inserted through an opening and the guide rails are located by features 50 and 52 of the door inner wherein the movement allows for door inner tolerances. Thereafter, the bracket is secured to the door.

Accordingly and in one embodiment, the system may be secured to the door inner as follows; first the lower distal end of the guide rails are inserted into the openings of features 50 and then the upper distal ends of the guide rails are received in features 52 thus, the guide rails are located or datumed by the door inner and then the bracket is secured to the door inner.

In one alternative embodiment the range of movement of the guide rails with respect to the door bracket in the direction of arrows 18 may be defined by a stop feature or engagement of a portion of feature 36 on bracket 16 such that limited ranges are defined by arrows 44. Of course, these ranges are merely provided as examples and exemplary embodiments of the present invention are not intended to be specifically limited to the ranges shown herein.

In one non-limiting exemplary embodiment, a portion 46 of feature 34 comprises an angled surface for engaging a portion of upper curved surface 37.

Door bracket 16 further comprises a plurality of mount openings 48 for securement of the bracket and ultimately the entire window lift system to the vehicle door inner. In one non-limiting exemplary embodiment, the mount openings are positioned in one of a pair of structural arm members 58 each of which extends from portions of the door bracket that define the door pull cup attachment or inside handle carrier. In addition and in one embodiment, the structural arm members are integrally molded with the bracket. Still further and in another embodiment, a vehicle door handle 70 is mounted to one of the structural arm members.

As illustrated and in one embodiment, the mount openings 48 are located proximate to distal ends of the structural arm members. In addition and as illustrated in at least FIGS. 2 and 3 and in one non-limiting embodiment, the bracket is mounted to a peripheral portion of an opening 20 of the vehicle door inner 22. In one implementation, the vehicle door inner is configured to have tab members or ears 54 extending into the opening 22 in order to provide a securement surface for the distal ends of the structural arm members.

Also illustrated in the FIGS. is that the window lift system is secured to the bracket and the bracket provides a simple and efficient means for securing the window lift system to the vehicle door inner.

In one non-limiting exemplary embodiment and where applicable, the components of the window lift system or assembly as well as the vehicle door inner are manufactured from an easily molded or formed such as plastic or equivalents thereof. In some instances all of the components are molded from plastic while in other embodiments only portions are molded from plastic.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A dual channel window lift assembly for a vehicle, comprising:

a door inner member;

a door bracket;

a pair of guide rails each being rotationally mounted to the door bracket about a respective independent axis for rotational movement in a predetermined range, wherein each independent axis is remotely positioned from opposite distal ends of each of the pair of guide rails; and a cable assembly secured to the door bracket wherein at least one cable of the cable assembly is not received within a conduit and the at least one cable is secured to at least one pulley rotationally mounted to the one of the pair of guide rails and the at least one cable remains on the at least one pulley as the pair of guide rails each rotate within the predetermined range, wherein the predetermined range is defined by limiting movement of each of the distal ends of the pair of guide rails.

2. The dual channel window lift assembly as in claim 1, further comprising a motor coupled to the at least one cable.

3. The dual channel window lift assembly as in claim 1, wherein the feature has a plurality of walls that define the opening and provide fore/aft, inboard/outboard and downward locational control of the bottom distal end of each of the pair of guide rails therein such that only each of the pair of guide rails is not constrained in an upward direction from the feature.

4. A dual channel window lift assembly for a vehicle, comprising:

a door inner member;

a door bracket;

a pair of guide rails each being rotationally mounted to the door bracket for rotational movement in a predetermined range; and a cable assembly secured to the door bracket wherein at least one cable of the cable assembly is not received within a conduit and the at least one cable is secured to at least one pulley rotationally mounted to the one of the pair of guide rails and the at least one cable remains on the at least one pulley as the pair of guide rails each rotate within the predetermined range, wherein a bottom distal end of each of the pair of guide rails is received in a feature of the door inner member, wherein the feature defines an opening for receipt of the bottom distal end of each of the pair of guide rails therein and wherein the feature has a plurality of walls that define the opening and provide fore/aft, inboard/outboard and downward locational control of the bottom distal end of each of the pair of guide rails therein such that only each of the pair of guide rails is not constrained in an upward direction from the feature; and wherein an opposite upward distal end of each of the pair of guide rails is held in another feature of the door inner member, the another feature being configured for 2-way locational control of the upward distal end of each of the pair of guide rails, the 2-way locational control being in opposite directions in the same plane.

5. The dual channel window lift assembly as in claim 4, wherein the door bracket is secured to a portion of each of the pair of guide rails disposed between the bottom distal end and the upward distal end of each of the pair of guide rails.

6. The dual channel window lift assembly as in claim 5, wherein the door bracket further comprises a pair of features that engages an opening in a respective one of the pair of guide rails, wherein the feature and the opening are configured to allow for rotational movement of each of the pair of guide rails with respect to the door bracket.

7. The dual channel window lift assembly as in claim 6, wherein each of the pair of guide rails further comprises a resilient arm member for engaging an upper curved surface of the door bracket after the feature engages the opening in each of the pair of guide rails.

8. The dual channel window lift assembly as in claim 7, wherein each of the pair of guide rails further comprises a lower feature configured to engage a lower curved surface of the door bracket after the feature engages the opening in each of the pair of guide rails.

9. The dual channel window lift assembly as in claim 8, wherein the lower feature and the upper feature of each of the pair of guide rails determine the predetermined range of rotational movement of each of the pair of guide rails with respect to the door bracket.

10. The dual channel window lift assembly as in claim 8, wherein the predetermined range of rotational movement of each of the pair of guide rails with respect to the door bracket allows for installation of the door bracket and each of the pair of guide rails to the door inner member.

11. The dual channel window lift assembly as in claim 8, wherein the lower feature is configured to provide a limit of angular movement of the door bracket with respect to each of the pair of guide rails.

12. The dual channel window lift assembly as in claim 7, wherein the resilient arm member further comprises an angled surface for engaging a portion of the upper curved surface.

13. The dual channel window lift assembly as in claim 12, wherein the lower feature is configured to provide a limit of angular movement of the door bracket with respect to each of the pair of guide rails.

14. A dual channel window lift assembly for a vehicle, comprising:

a door bracket;

a pair of guide rails each being rotationally mounted to the door bracket for rotational movement in a predetermined range; and a cable assembly secured to the door bracket wherein at least one cable of the cable assembly is not received within a conduit and the at least one cable is secured to at least one pulley rotationally mounted to the one of the pair of guide rails and the at least one cable remains on the at least one pulley as the pair of guide rails each rotate within the predetermined range, wherein the door bracket is secured to a portion of each of the pair of guide rails disposed between a bottom distal end and an upward distal end of each of the pair of guide rails and wherein the door bracket further comprises a feature that engages an opening in each of the pair of guide rails, wherein the feature and the opening are configured to allow for rotational movement of each of the pair of guide rails with respect to the door bracket, wherein each of the pair of guide rails further comprises a resilient arm member for engaging an upper curved surface of the door bracket after the feature engages the opening in each of the pair of guide rails and wherein each of the pair of guide rails further comprises a lower feature configured to engage a lower curved surface of the door bracket after the feature engages the opening in the each of the pair of guide rails and wherein the lower feature and the upper feature of each of the pair of guide rails determines the predetermined range of rotational movement of each of the pair of guide rails with respect to the door bracket.

* * * * *